United States Patent [19]

Cherian et al.

[11] 4,262,986

[45] Apr. 21, 1981

[54] ELECTRICAL INTERCONNECT DEVICE

[75] Inventors: Gabriel B. Cherian, York; William S. Scheingold, Audubon; Steven J. Kandybowski, Tower City, all of Pa.

[73] Assignee: AMP Incorporated, Harrisburg, Pa.

[21] Appl. No.: 75,292

[22] Filed: Sep. 12, 1979

[51] Int. Cl.[3] ..... H01R 13/24

[52] U.S. Cl. ..... 339/252 R; 339/17 CF

[58] Field of Search ..... 339/252 R, 17 C, 17 CF, 339/17 M, 17 LM

[56] References Cited

U.S. PATENT DOCUMENTS

| | | | |
|---|---|---|---|
| 3,701,071 | 10/1972 | Landman | 339/17 M |
| 3,846,737 | 11/1974 | Spaulding | 339/17 CF |
| 4,052,118 | 10/1977 | Scheingold et al. | 339/17 CF |
| 4,093,330 | 6/1978 | Pittman | 339/17 CF |
| 4,166,665 | 9/1979 | Cutchan | 339/17 CF |

*Primary Examiner*—John McQuade

*Attorney, Agent, or Firm*—Allan B. Osborne; Jay L. Seitchik

[57] ABSTRACT

The present invention relates to an interconnect device to provide electrical connections between printed circuit boards or a supported flexible circuit board and a wire wrap connection or solder tail connection or the like. More specifically the preferred embodiment of the invention includes a device, stamped and formed from a coplanar strip of conductive material and having a double thickness leg on top of which is an elongated spring arm formed into a rectangular shape to reduce the height it occupies in a housing while providing high spring force. Additionally, stress-distribution means is incorporated into the device.

2 Claims, 4 Drawing Figures

ELECTRICAL INTERCONNECT DEVICE

BACKGROUND OF THE INVENTION

1. Field of the Invention

This invention is in the field of devices used to provide a connection between a printed circuit board of a supported flexible circuit board and a tail for wire wrapping or soldering or the like. 2. The Prior Art Interconnect devices are well known. The majority of such devices are found in DIP headers such as the one disclosed in U.S. Pat. No. 3,696,323, leadless integrated circuit package connectors such as disclosed in U.S. Pat. No. 4,052,118 and in zero or low insertion force connectors such as taught by U.S. Pat. No. 4,080,032.

The present invention falls between the last two mentioned patent teachings in that provisions are incorporated for surface contact on one end; e.g., U.S. Pat. No. 4,052,118 and for insertion capability on the other end; e.g., U.S. Pat. No. 4,080,032.

SUMMARY OF THE PRESENT INVENTION

The present invention discloses a device having a leg for insertion into a printed circuit board or onto which a wire may be wrapped, an elongated contact-carrying spring arm having a low profile and high spring forces combined with large flexibility; i.e., large deflection capability. These features compensates for large tolerances in the housing. Further these features provide good contact characteristics. Also the device includes a support member which distributes stresses imposed the supporting printed circuit board or supporting structure. This eliminates the need for a strong and rigid support of the solder tail.

DESCRIPTION OF THE PREFERRED EMBODIMENT

Figure 1:
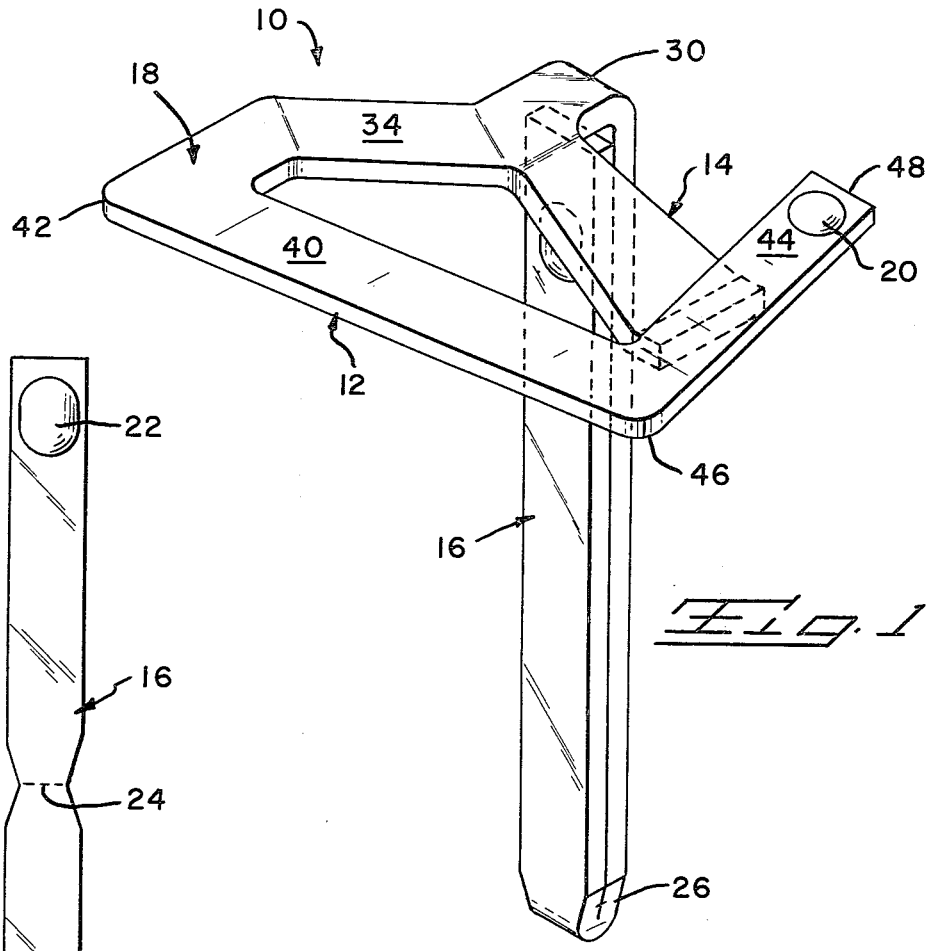
FIG. 1 shows in perspective, the preferred embodiment of the present invention.

Device 10, constructed in accordance with the concepts of the present invention, is shown perspectively in FIG. 1. The three major components thereof are the contact-carrying spring arm 12, support member 14 and leg 16. The spring arm and support member collectively form upper portion 18 of the device.

Figure 2:
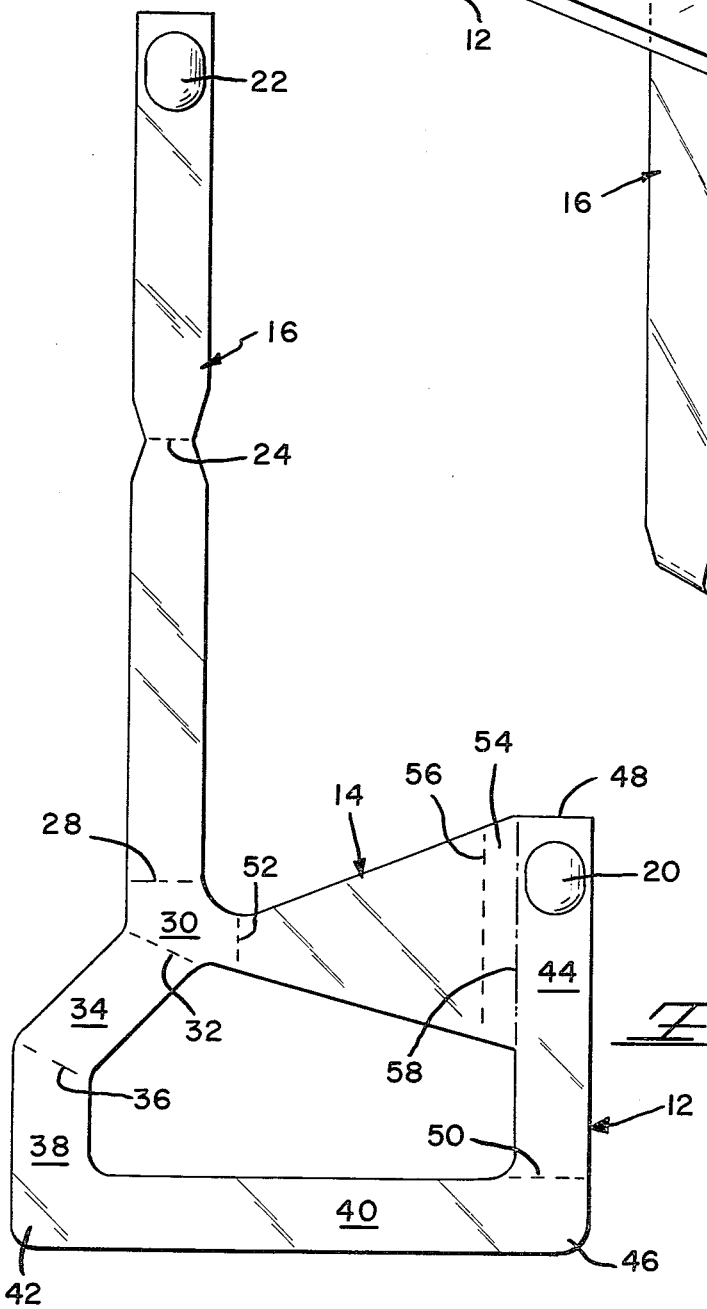
FIG. 2 shows the device of FIG. 1 subsequent to its being blanked out or stamped from a coplanar strip of conductive material.

The device, as blanked or stamped out from a coplanar strip of material, but before forming, is shown in FIG. 2.

During the blanking operation, contact 20 on spring arm 12 and retention dimple 22 on leg 16 are formed.

The device is shown in FIG. 2 after being stamped from flat stock. After forming, as shown in FIG. 1, it is L-shaped with upper portion 18 being generally at right angles to leg 16.

The way or method of forming device 10 is shown by the several bend lines on the stamped blank in FIG. 2. Leg 16 is formed into double thickness by bending the outer half about bend line 24. Note that the width of the leg has been reduced at the bend line to provide a beveled lead-in tip, indicated by reference numeral 26 in FIG. 1. The double thickness provides strength and wire wrapping capabilities.

Bend line 28, located inwardly from bend line 24, indicates the place where the device is formed into its final L-shape. This is obviously a ninety degree bend.

With references to FIGS. 1 and 2, connecting strap 30 is the common focus between spring arm 12, support member 14 and leg 16.

The spring arm's point of attachment with strap 30 coincides with bend line 32. The arm is bent upwardly to where it first portion 34 is at an angle with respect to strap 30. This first portion also extends laterally from the strap at about a forty-five degree angle to increase the spring arm's total effective length.

The next bend line of the arm, pointed out by reference number 36, establishes the point where the aforementioned upward bend and lateral extension terminates and also the division between the first portion 34 and second portion 38.

The third portion 40 of the arm is relatively long and parallels the leg'width; i.e., at about ninety degrees to portion 38. Its junction with second portion 38 is at the first right angle bend in the arm pointed out by reference numeral 42.

The fourth and final portion of the spring arm is designated by reference numeral 44. It begins at the arm's second right angle corner 46 and ends at the arm's free end 48.

The third and fourth portions of the arm is bent upwardly as a unit with the second portion 38 providing the axis of rotation. In addition to the overall bend, the fourth portion 44 is bent upwardly. Bend line 50 shows that point of bending being adjacent corner 46.

Support member 14 is likewise bent away from the horizontal plane but in a direction opposite to spring arm 12; i.e., it is bent downwardly. Bend line 52, seen in FIG. 2, shows that the support member is bent downwardly at its point of attachment to connecting strap 30.

A second bend adjacent the member's free end is bent in the reverse direction so that the free end, designated by reference number 54, is horizontal. The location of the reverse bend is indicated by reference numeral 56. The free end 54, is shown in phantom in FIG. 1.

As shown in FIGS. 1 and 2, the width of the support member increases to a maximum at its foot or free end. The increased width provides greater contact area on the housing (FIGS. 3 & 4), to reduce stresses.

The device is stamped or blanked out in one piece. Prior to forming, the support member 14 is separated from the spring arm's fourth portion with the cut being along line 58.

Figure 3:
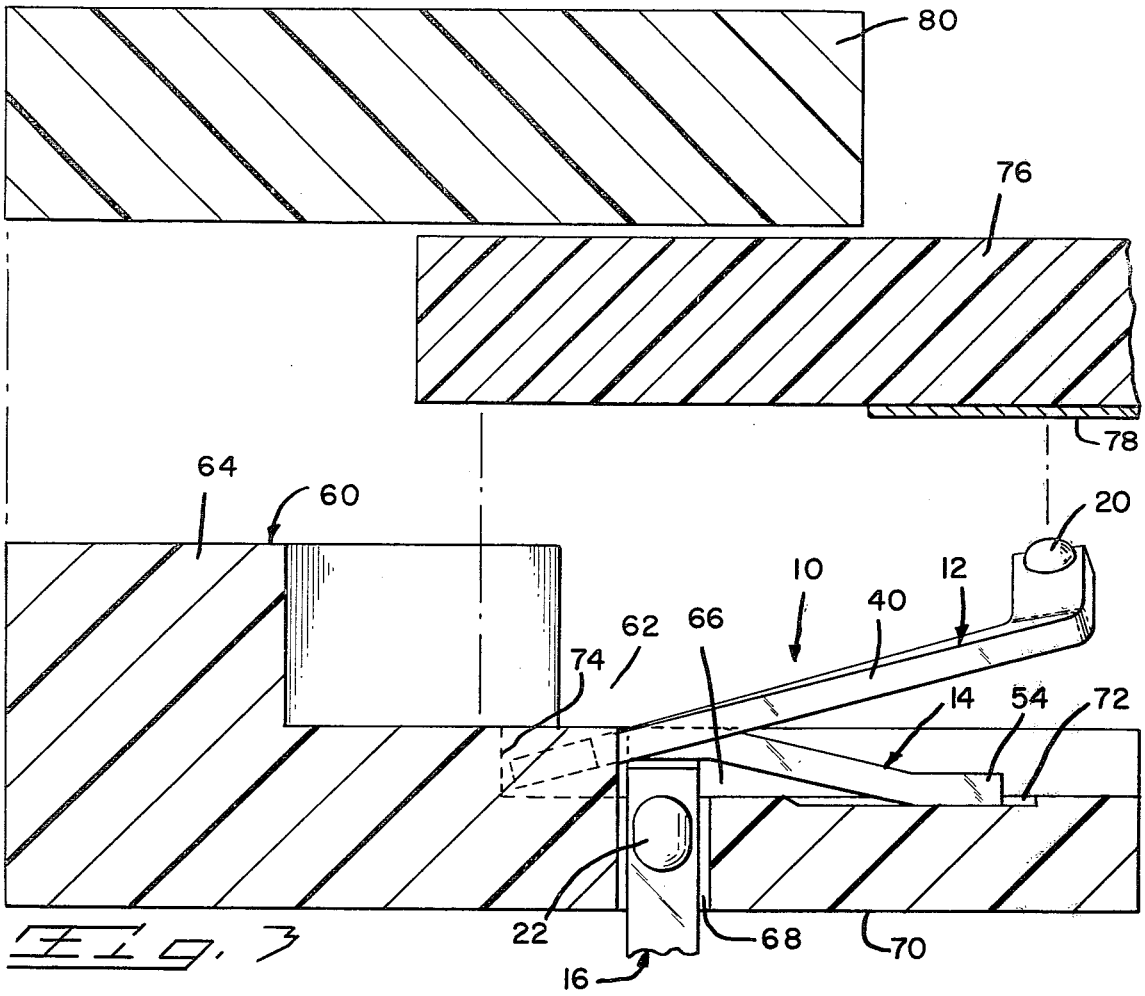
FIGS. 3 and 4 demonstrate its use.
Figure 4:
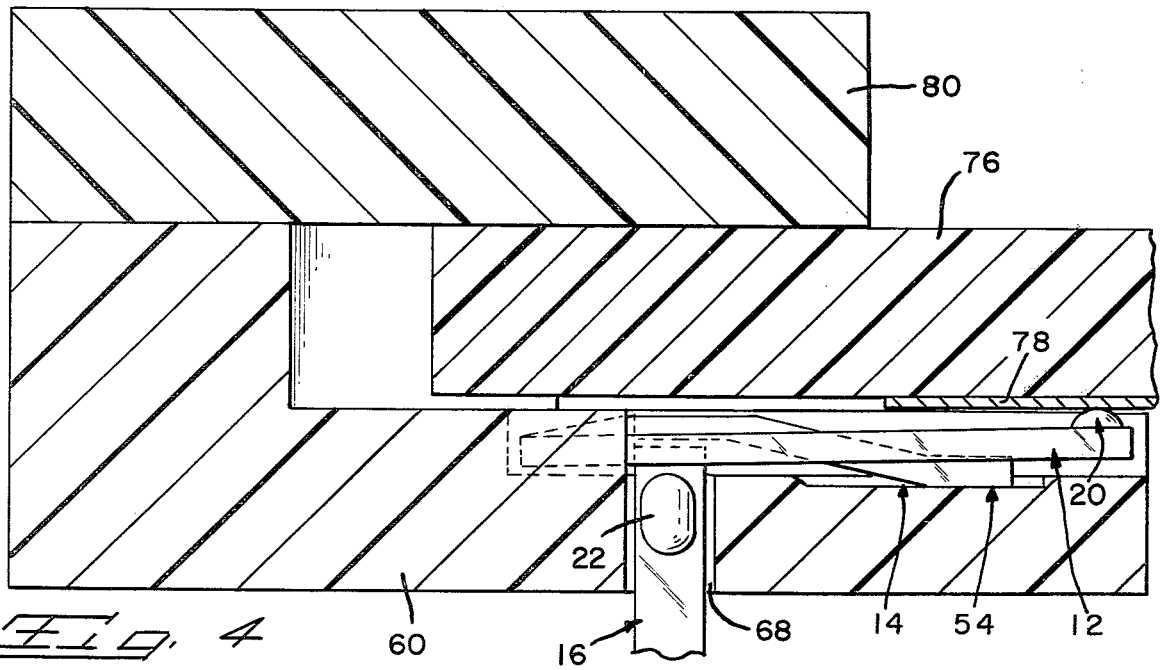

FIGS. 3 and 4 illustrate the utility of and housing for device 10. The housing, indicated generally by reference numeral 60, is made from a non-conductive material such as glass fill nylon or the like. This housing (not completely shown) is a rectangular structure having a central compartment 62 defined by side walls 64. A plurality of sites 66 are located around the perimeter of the central compartment. Holes 68 extend from the sites to the lower surface 70 of the housing.

The sites include a recessed section 72 for receiving support member 14 and section 74 for receiving the spring arm's first and second portions 34 and 38. This latter section is shown in phantom in the drawings.

Devices 10 are placed into the housing sites by inserting the legs 16 into holes 68 which are sizes to just slidably receive them. Dimple 22 bears against a wall of the hole to retain the device in the housing. As shown in FIGS. 3 and 4, support member 14, and more particularly, its foot or free end 54, bears against the surface of site section 72. The spring arm portion 38 does not contact the floor of site section 74 but simply occupies the area.

FIG. 3 also shown the structural relation between bent spring arm 12 and support member 14, leg 16.

With continued reference to FIG. 3, printed circuit board (PCB) 76 or the like, having conductive traces 78 on its undersurface is shown above housing 60. A retainer member 80 is shown above the PCB. This member is made from the same or similar non-conductive material as housing 60.

FIG. 4 is a view showing PCB 76 loaded into housing 60 with retainer member 80 in place. Spring arm 12 has been resiliently depressed so that it will continuously exert pressure against trace 78 for good electrical contact. Dimple 20 on the arm provides the preferred point contact with the trace.

The forces, i.e., compressive stresses, being exerted downwardly by PCB 76 through retainer member 80 is distributed and absorbed by support member 14 and housing 60 through foot or free end 54. Note that none of the spring arms contact the housing.

Retainer member 80 is secured to the housing by conventional fastening techniques.

It is to be understood that the forms of the invention shown and described herein are but preferred embodiments thereof and that various changes and modifications can be made therein without departing from the spirit or scope of the invention.

What is claimed is:

1. A device for providing an electrical interconnect between diverse electronic components, comprising:

a. a lower section comprising a leg for insertion into a board or the like or about which a wire may be wrapped; and b. an upper section connected and positioned perpendicularly to the lower section and having a connecting strap and an elongated spring arm which includes a first portion extending obliquely from said strap, a second portion connected to the first portion and extending in a direction parallel to the strap, a third, elongated portion connected to and extending at right angles to the second portion and a fourth portion connected to the third portion and extending back towards the leg, said fourth portion being the free end of the spring arm and having a contact thereon adapted to engage a conductive trace on a generally rigid circuit board or the like.

2. The device of claim 1 further including support member extending from the connecting strap towards the free end of the spring arm and preloaded downwardly, said support member adapted to transfer and distribute compressive stresses which may be exerted against a housing in which the device may be placed.

* * * * *